US005755108A

United States Patent [19]

Ibrahim et al.

[11] Patent Number: 5,755,108

[45] Date of Patent: May 26, 1998

[54] WEDGE TYPE REFRIGERATED DISPLAY CASE

[75] Inventors: Fayez F. Ibrahim, Niles; Thomas L. Dickey, Buchanan; Kamal G. Eskander, Niles, all of Mich.

[73] Assignee: Kysor Industrial Corporation, Cadillac, Mich.

[21] Appl. No.: 759,173

[22] Filed: Dec. 3, 1996

[51] Int. Cl.[6] ..... A47F 3/04

[52] U.S. Cl. ..... 62/256

[58] Field of Search ..... 62/255, 256

[56] References Cited

U.S. PATENT DOCUMENTS

| | | | |
|---|---|---|---|
| 2,594,066 | 4/1952 | Pabst | 62/89.5 |
| 2,836,039 | 5/1958 | Weber | 62/89.5 |
| 3,063,252 | 11/1962 | Lamb | 62/234 |
| 3,063,256 | 11/1962 | Lamb | 62/256 |
| 3,103,796 | 9/1963 | Dickson | 62/234 |
| 3,125,864 | 3/1964 | Ural | 62/256 |
| 3,186,185 | 6/1965 | Bently | 62/255 |
| 3,218,822 | 11/1965 | Bently | 62/256 |
| 3,289,432 | 12/1966 | Brennan | 62/256 |
| 3,306,068 | 2/1967 | Allgeyer et al. | 62/256 |
| 3,324,676 | 6/1967 | Gerweck | 62/256 |
| 3,369,375 | 2/1968 | Gerweck | 62/256 |
| 3,690,118 | 9/1972 | Rainwater | 62/250 |
| 3,696,630 | 10/1972 | Bressick | 62/188 |
| 3,756,038 | 9/1973 | MacMaster | 62/256 |
| 3,827,254 | 8/1974 | MacMaster | 62/256 |
| 4,314,458 | 2/1982 | Hade et al. | 62/256 |
| 4,760,708 | 8/1988 | Karashima | 62/256 |
| 4,938,034 | 7/1990 | Rosanio | 62/256 |

FOREIGN PATENT DOCUMENTS

| | | | |
|---|---|---|---|
| 225882 | 9/1989 | Japan | 62/256 |

*Primary Examiner*—William E. Tapolcai

*Attorney, Agent, or Firm*—Price, Heneveld, Cooper, DeWitt and Litton

[57] ABSTRACT

A refrigerated display case having a configuration resulting in a restricted air flow recirculation channel, such as a wedge shape, and comprising a housing having a bottom, a top, and defining a display space and an access thereto, the housing having a lower well and at least one shelf above the well, a refrigeration coil beneath the well, an air inlet to the coil from the display space, and an air outlet from the coil, at least one fan adjacent the coil for propelling air from the air inlet, through the coil, to the air outlet, an air flow opening from the outlet the well, the display case having a configuration forming a restricted vertical air flow channel from the outlet up the case to the top, an air discharge opening from the channel down toward the air inlet to the coil, and at least one fan in the channel adjacent the top for drawing air up the channel and discharging the air through the discharge opening.

11 Claims, 5 Drawing Sheets

WEDGE TYPE REFRIGERATED DISPLAY CASE

BACKGROUND OF THE INVENTION

This invention relates to refrigerated display cases, and particularly to refrigerated display cases with unusual configurations such as a wedge shape, resulting in restricted return air flow conduit space at the rear of the case.

Typically refrigerated display cases of the open front or glass door front types utilize recirculating refrigerated air that traverses the lower evaporative coil and then is propelled up through the rear duct in the back of the case to the top, from where it flows downwardly across the front to the return duct for recirculation to the coil. The rear duct extends the full width of the case behind the storage shelves, thereby providing considerably ample conduit space for air flow back to the top.

Recent trends in the supermarket industry require continuous refrigerated display extension around corners and angle walls, as well as other shapes or configurations of the refrigerated displays, e.g., cylindrical, i.e., round or polygonal in cross section. Wedge shaped refrigerated display cases could conceivably be used to fill the need to go around corners and angle walls. Refrigerated outside wedges and other shapes like circular or polygonal displays, however, have more compact and therefore restricted air flow ducts resulting in marginal performance of the case.

SUMMARY OF THE INVENTION

This invention presents a new type of display case assembly resulting in proper refrigeration for display case wedges, as well as other shapes such as circular or polygonal shaped cylinders.

An object of this invention, therefore, is to provide unusually shaped refrigerated display cases with special refrigerated air flow features effecting proper performance for the case. Although a narrow case back resulting in restricted air flow through the return duct might exit, this air flow is complemented by special air flow facilities in the shelf area of the display case. This special air flow resulting preferably from air moving directly through the lowermost shelf at the rear thereof, and/or through outlets at the rear wall to flow over the shelves, preferably by use of a special second rear duct and vents through the rear wall panel, achieves a combination of air flow characteristics resulting in effective and efficient performance of the case.

These and other objects, advantages and features of the invention will become apparent upon studying the following specification in conjunction with the drawings.

DESCRIPTION OF THE PREFERRED EMBODIMENTS

Figure 1:
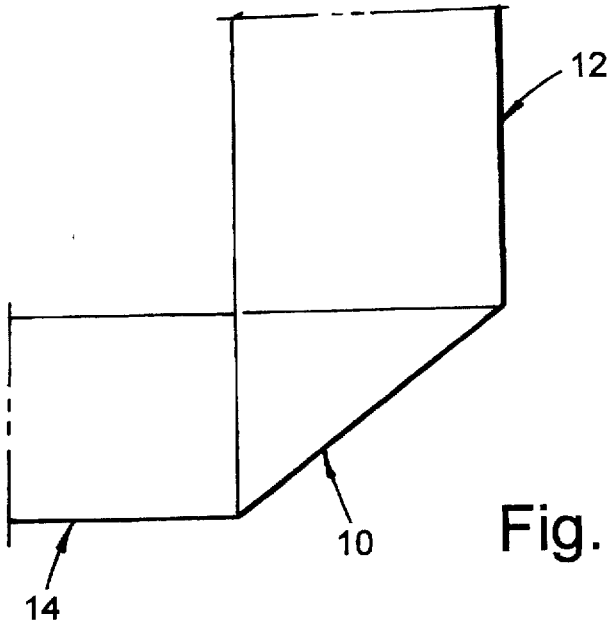
FIG. 1 is a schematic view of a multipart refrigerated display case assembly employing two conventional elongated display cases adjacent a corner, and a novel wedge shaped display case at the corner.
Figure 2:
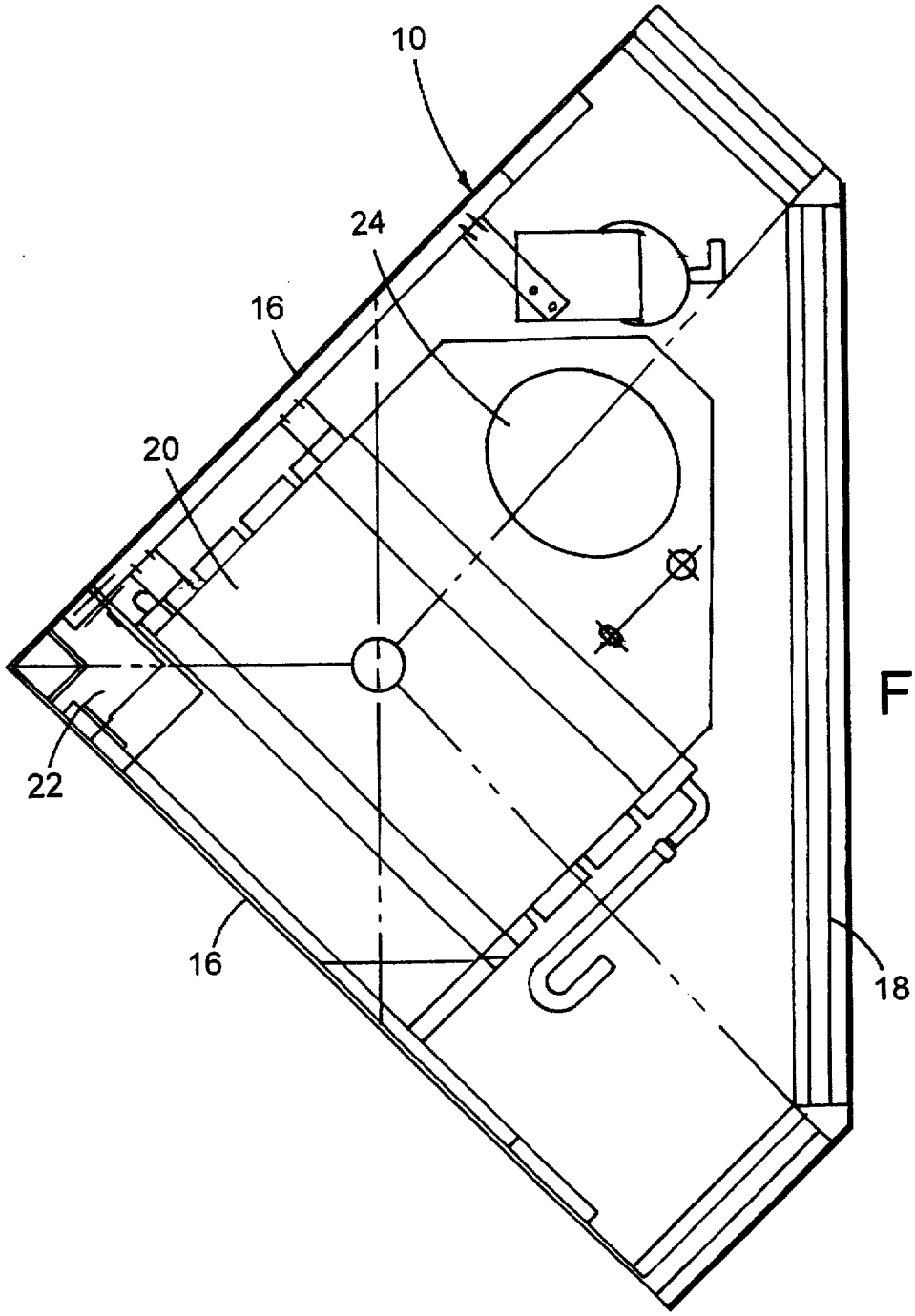
FIG. 2 is an enlarged cross sectional view of the lower part of the wedge shaped display case in FIG. 1.

Referring now specifically to FIG. 1 of the drawings, the schematic diagram illustrates an arrangement where a pair of refrigerated display cases 12 and 14 are adjacent an interior corner of a store or super market, leaving a space therebetween. In the drawing, a wedge-shaped refrigerated display case 10 according to this invention is located in that space. A cross section of the bottom portion of that wedge-shaped case is depicted in FIG. 2. This case includes a pair of back walls 16 which converge and meet at the rearmost portion of the case. The widest portion of the case is an access 18 which can be an open front or a door type reach-in assembly of conventional type. At the bottom of the display is a refrigeration evaporator coil 20 of conventional type, through which the recirculated air passes in order to cool it. The evaporator coil has an air inlet to receive air from the display case, and an air outlet which communicates with a restricted passage or channel 22 at the rear of the case, for vertical flow of the cooled air from the bottom of the case up to the top of the case. Air is propelled through coil 20 by one or more fans 24 adjacent the coil.

Figure 3:
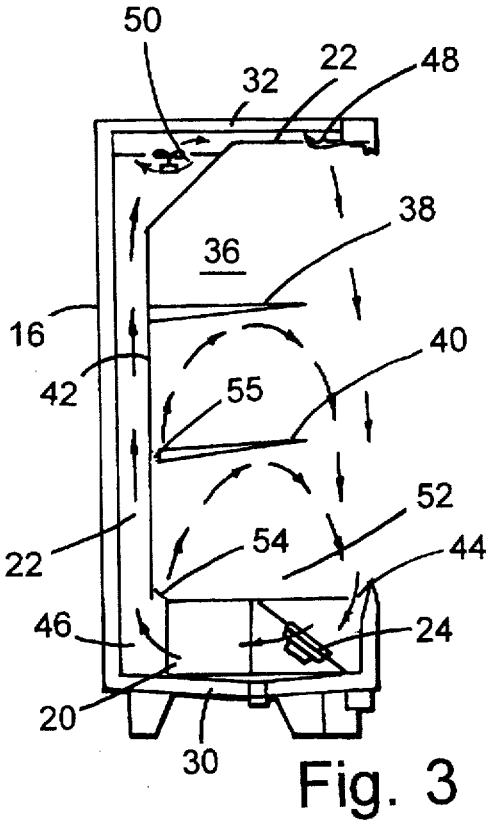
FIG. 3 is a side elevational sectional view of a first embodiment of an open front wedge type display case according to this invention.
Figure 4:
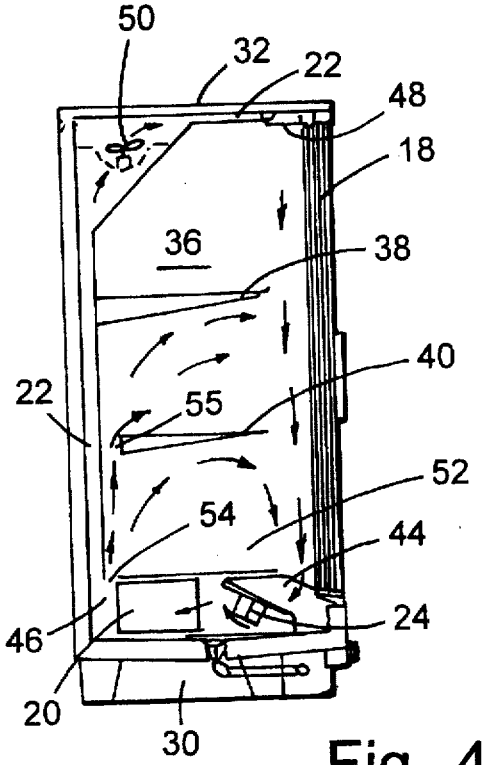
FIG. 4 is a side elevational sectional view of a glass front refrigerated display case employing the first embodiment of this invention.
Figure 6:
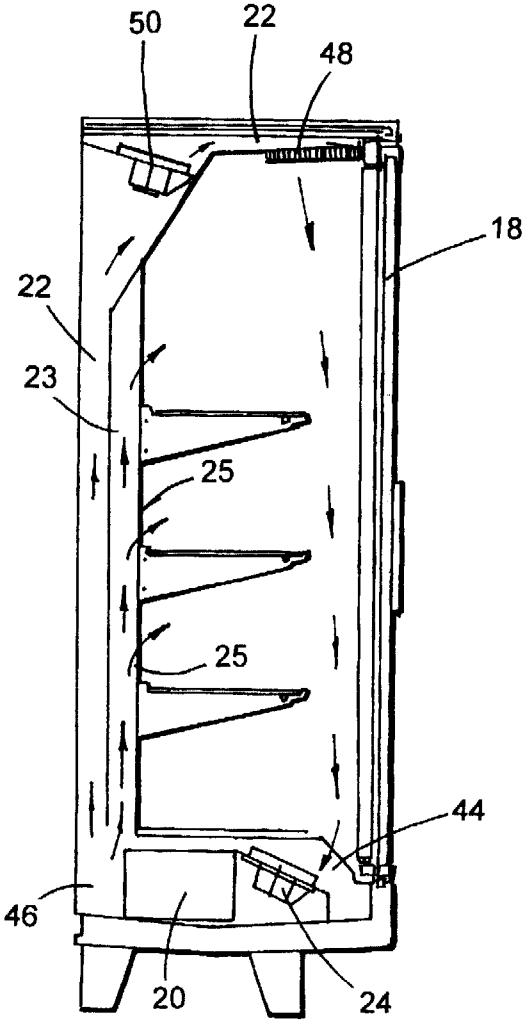
FIG. 6 is a side elevational sectional view of the glass door type employing the second embodiment of this invention.
Figure 5:
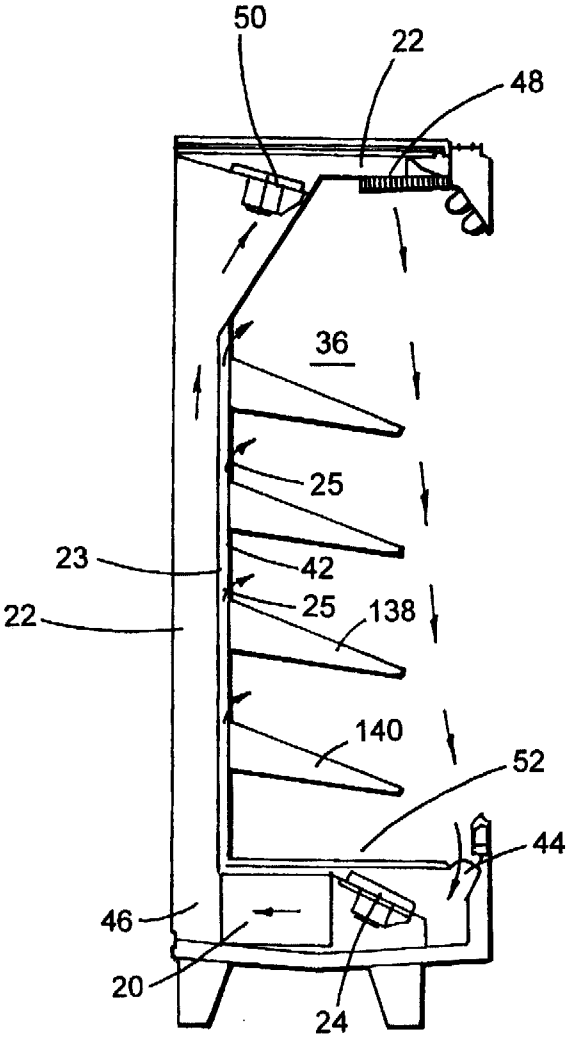
FIG. 5 is a side elevational sectional view of a second embodiment of open front display case employing this invention.
Figure 7:
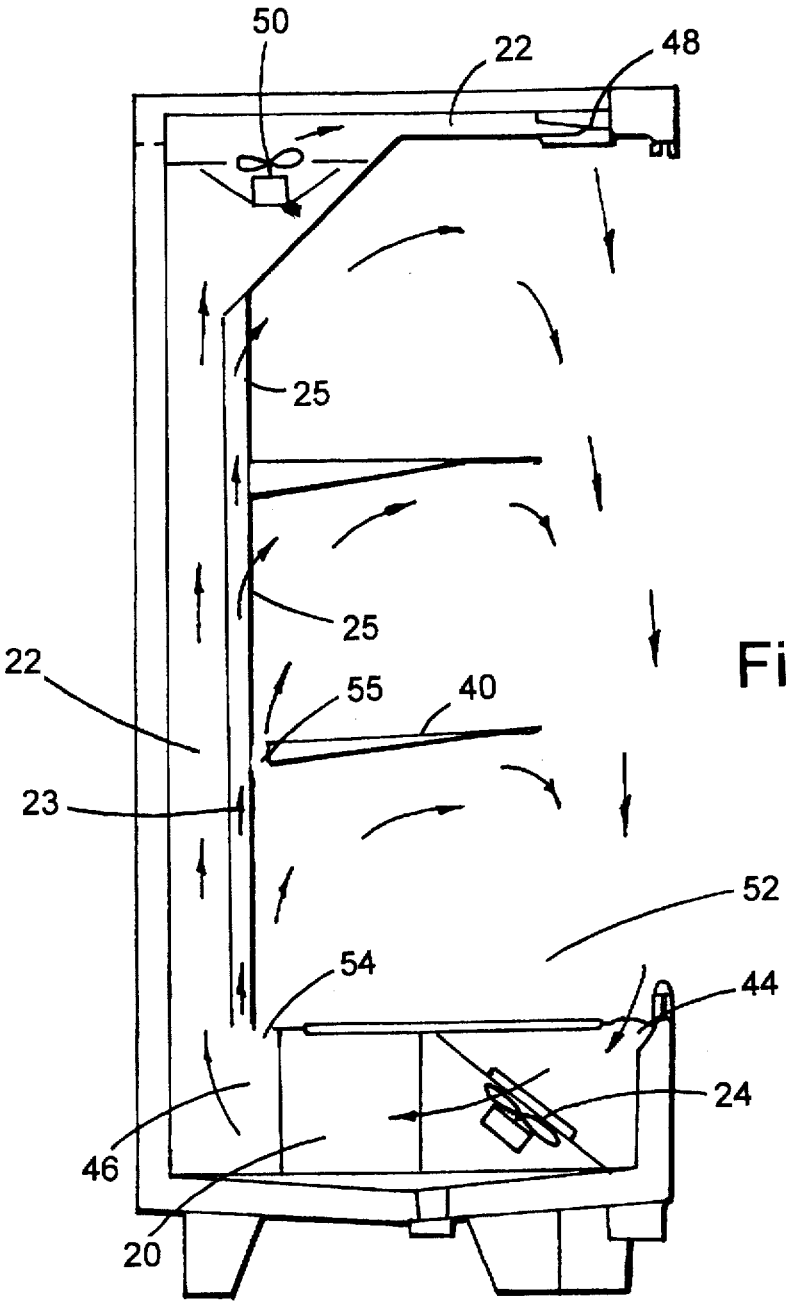
FIG. 7 is a side elevational sectional view of an open front display case employing a third embodiment of this invention.

FIGS. 3 and 4 show the first embodiment of this wedge case, FIG. 3 showing an open front type and FIG. 4 showing a glass door reach-in type; FIGS. 5 and 6 show a second embodiment of the wedge-type case, FIG. 5 showing an open front type and FIG. 6 showing a glass door reach-in type; and FIG. 7 shows a third embodiment of the wedge case.

Referring now specifically to FIGS. 3 and 4, the display case includes a bottom 30, a top 32, a back 16, a display space 36 having at least one, and here shown to be two, display shelves 38 and 40 mounted in cantilever fashion at the back wall panel 42. At the bottom 30 is the refrigeration evaporator coil 20 with an air inlet 44 to the coil, an air outlet 46 from the coil, and at least one fan 24 adjacent the coil for propelling air therethrough. Outlet 46 from the coil communicates with the upward channel 22 between back panel 42 of the display space and back wall 16. Channel 22 extends upwardly from the bottom of the case to the top thereof and across to the front of the case to an air outlet discharge 48 oriented downwardly in front of the case toward the inlet 44. Outlet 48 may have suitable air directing honeycomb or the like therein in conventional fashion. At least one fan 50 is mounted at the top of the case for drawing air up channel 22 and propelling it across the top and through opening 48. The air flowing down in front of the shelves 38 and 40 forms an air curtain in the case of FIG. 3 to pneumatically separate the display space 36 from the ambient atmosphere. Above the coil is an area typically called the well 52, which is the space beneath the bottom-most shelf 40 in the display space. Outlet 46 from the coil also communicates with an opening 54 to the well 52.

Preferably bottom shelf 40 includes at the rear portion thereof an orifice 55 through the shelf to allow air to flow from the well 52 through shelf 40 to the space above the shelf and over the shelf to the front for flow back to the inlet 44.

Thus, in spite of the restricted nature of channel 22, efficient and effective cooling can be achieved.

Referring now to FIG. 4, the display case is similar to that in FIG. 3 except that the front access includes openable doors 18 at the access for reach-in to the display space 36. Otherwise the case is like that in FIG. 3, including a top 32, a bottom 30, evaporator coil 20, air inlet 44, fan 24, air outlet 46, restricted vertical channel 22 leading to the portion of the channel across the top, fan 50 and discharge 48. The shelves 38 and 40 are above one another, the bottom shelf 40 showing an orifice 55 for air flow from the well 52 up through shelf 40. Opening 54 allows air flow from the outlet 46 down in front of the shelves to the well 52 and inlet 44.

The second embodiment depicted in FIGS. 5 and 6 differs somewhat from the first embodiment in FIGS. 3 and 4 by including a pair of vertical channels at the rear of the case. More specifically, referring to FIG. 5, there is shown not only the restricted vertical channel 22 from outlet 46 up to the top of the case and fan 50, but also a second vertical channel 23 immediately adjacent the back panel 42. This embodiment also illustrates a plurality of four shelves above the well area 52. Above each shelf in back panel 42 are vents 25 to allow air to flow from channel 23 to the display space 36 above each shelf and over each shelf to the front of the case where the air curtain flowing down from outlet 48 through the air inlet 44 will entrain this air flow and cause it to recirculate. Thus, air entering at inlet 44 and propelled by fan 24 through the evaporator coil 20 to outlet 46 not only flows up vertical restricted channel 22 as drawn by fan 50 and across the top of the case to outlet 48 for discharge of the air down the front access, but also air from outlet 46 is propelled up channel 23 and through the vent 25 above the shelves 140, 138, etc. to join the air flowing down in front of the shelves and thereby cooperate with the other portions of recirculating air for efficient and effective functioning of the case.

The structure in FIG. 6 has many similarities to that in FIG. 5, but includes a front door assembly 18 for reach-in access. It also includes the channel 23 as well as 22. The structure is here shown to include a plurality of three shelves, with back wall vents 25 above each shelf for air flow over the shelf and forwardly thereof to be entrained by the downwardly moving air from outlet 48 of channel 22. This downwardly flowing air moves into the inlet 44 to the evaporator coil 20 as drawn by fan 24, the air through the coil then exiting at outlet 46 for discharge into both channels 22 and 23. Air in channel 22 is drawn upwardly by fan 50.

The embodiment in FIG. 7 differs from that in FIGS. 3 and 5 in that it combines certain features of those in the first and second embodiments. Thus this display case in FIG. 7 includes not only the channel 23 as well as the restricted channel 22 and vents 25 above the respective shelves, two of which are here shown, but also the outlet 46 from the refrigerator coil 20 communicates not only with channel 22 and channel 23, but also with an orifice 54 to the well area 52 above the coil, for refrigerated air flow through opening 54 to the well area and through orifice 55 in shelf 40 through the space above the shelf. In operation, therefore, air is drawn into inlet 44 by fan 24 and propelled through coil 20 to outlet 46 from whence it flows in three directions, one being up channel 22, which air is also drawn by fan 50 for propulsion through the outlet 48 down the front of the case. Air also flows up channel 23 through vents 25 to flow over the respective shelves. Thirdly, it flows through orifice 54 to the well 52. The air flowing over the shelves and through the well is entrained by the return air curtain moving back to inlet 44.

Figure 9:
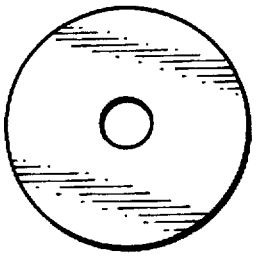
FIG. 9 is a top plan view of the display case in FIG. 8.
Figure 10:
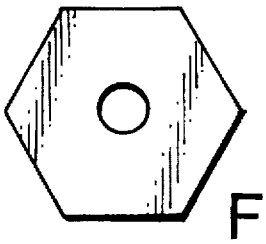
FIG. 10 is a top plan view of an alternative cylindrical configuration with a polygonal cross section according to the invention herein.
Figure 8:
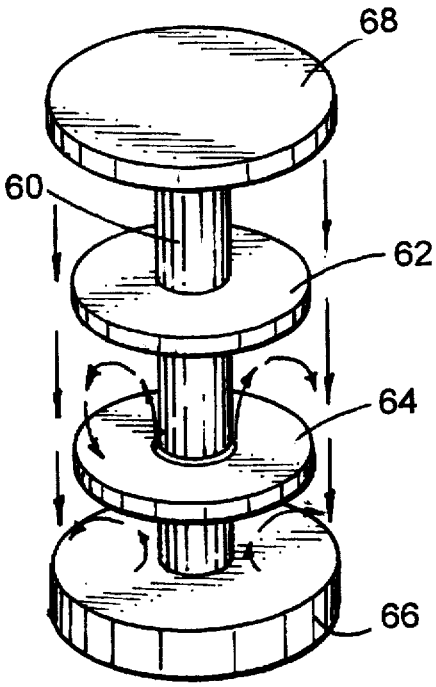
FIG. 8 is a perspective view of a cylindrically configurated display case with a circular cross section.

In FIGS. 8–10 is shown another type of case which would include a restricted vertical passage or channel. In this embodiment, the display case is upright cylindrical in nature, being either circular in cross section as in FIG. 9 or polygonal in cross section as in FIG. 10. The display case includes a central column 60 and a plurality of shelves 62 and 64 mounted thereon, in a display space which is formed between the base 66 of the case and the top 68. In the base is an evaporator coil as well as an air inlet to the coil and an air outlet from the coil. The air flows upwardly through the column 60 to top 68 where it extends outwardly to the periphery of the top to flow down in a generally cylindrical air curtain adjacent the peripheral outer edges of shelves 62 and 64 to return to the base 66. Furthermore, air flows out of the column to the space above the respective shelves for cooperatively cooling the display space.

In addition to the various preferred embodiment depicted herein as illustrative of the invention, conceivably other variations could be incorporated to suit particular available store space. Hence, the invention is not intended to be limited to the specific preferred embodiments set forth, but only by the scope of the appended claims as interpreted, including interpretation under the doctrine of equivalents.

The embodiments of the invention in which an exclusive property or privilege is claimed are defined as follows:

1. A wedge-shaped refrigerated display case comprising:

a housing having a bottom, a top, and a back defining a display space and a front access thereto;

said housing having a lower well;

at least one shelf above said well;

a refrigeration coil beneath said well, an air inlet from said display space to said coil, and an air outlet from said coil, and fans adjacent said coil for propelling air through said coil;

an air flow opening from said outlet to said well;

an air flow orifice from said well through said shelf to the display space above said shelf;

a restricted vertical air flow channel from said outlet up said case back to said top, and across said top;

an air discharge opening from said channel down toward said air inlet to said coil; and at least one fan in said channel adjacent said top for drawing air up said channel and discharging the air through said discharge opening.

2. The refrigerated display case in claim 1 wherein said air flow orifice is through the rear of said shelf.

3. The refrigerated display case in claim 1 including a second vertical channel having vents to said display space above said shelf.

4. A refrigerated display case comprising:

a housing having a bottom a top and defining a display space and an access thereto; said housing having a lower well;

at least one shelf above said well:

a refrigeration coil beneath said well an air inlet to said coil from said display space, and an air outlet from said coil;

at least one fan adjacent said coil for propelling air from said air inlet, through said coil, to said air outlet;

an air flow opening from said outlet to said well;

said display case having a configuration forming a restricted vertical air flow channel from said outlet up said case to said top;

an air discharge opening from said channel down toward said air inlet to said coil;

at least one fan in said channel adjacent said top for drawing air up said channel and discharging the air through said discharge opening; and a second vertical channel having vents to said display space above said shelf.

5. The refrigerated display case in claim 4 wherein said configuration is a wedge shape with said front access being wider than other portions of said case.

6. The refrigerated display case in claim 4 wherein said configuration is upright cylindrical.

7. The refrigerated display case in claim 6 wherein said configuration is polygonal in cross section.

8. The refrigerated display case in claim 6 wherein said configuration is circular in cross section.

9. A refrigerated display case comprising:

a housing having a bottom, a top, and a back defining a display space and a front access thereto;

said display space having a back panel;

said housing having shelves in said display space mounted at said back panel;

a refrigeration coil at said case bottom, an air inlet from said display space to said coil, an air outlet from said coil, and fans for propelling air through said coil to said air outlet;

a pair of restricted vertical air flow channels from said outlet up said case back, one of said channels extending to said top, and across said top, and the other channel extending up along said back panel;

an air discharge opening from said one channel down toward said air inlet to said coil;

at least one fan in said one channel for moving air up said channel and discharging the air through said discharge opening; and air flow vents in said back panel above said shelves for air flow from said other channel to said display space over said shelves.

10. A refrigerated display case comprising:

a housing having a bottom, a top, and a back defining a display space and a front access thereto;

said housing having a lower well;

at least one shelf above said well;

a refrigeration coil beneath said well, an air inlet to said coil from said display space, and an air outlet from said coil;

at least one fan adjacent said coil for propelling air from said air inlet, through said coil, to said air outlet;

an air flow opening from said outlet to said well;

an air flow orifice through said shelf for air flow from said well to above said shelf; said display case having a configuration forming a first restricted vertical air flow channel from said outlet up said case back to said top;

an air discharge opening from said first channel down toward said air inlet to said coil;

at least one fan in said first channel adjacent said top for moving air up said channel and discharging the air through said discharge opening;

a second vertical channel from said outlet up said case back, and having vents to said display space above said shelf.

11. The refrigerated display case in claim 10 wherein said at least one shelf comprises a plurality of vertically spaced shelves, and said vents to said display space are above respective ones of said shelves.

* * * * *